US007024873B2

(12) United States Patent
Yoo

(10) Patent No.: US 7,024,873 B2
(45) Date of Patent: Apr. 11, 2006

(54) REFRIGERATOR AND METHOD FOR CONTROLLING THE SAME

(75) Inventor: Han Joo Yoo, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 63 days.

(21) Appl. No.: 10/814,790

(22) Filed: Apr. 1, 2004

(65) Prior Publication Data

US 2005/0217289 A1 Oct. 6, 2005

(30) Foreign Application Priority Data

Mar. 30, 2004 (KR) ..... 10-2004-0021496

(51) Int. Cl.
*F25D 17/00* (2006.01)
*F25B 1/00* (2006.01)
*F25B 39/04* (2006.01)

(52) U.S. Cl. ..... 62/181; 62/229; 62/507

(58) Field of Classification Search ..... 62/126, 62/129, 180, 181, 228.1, 229, 506, 507
See application file for complete search history.

(56) References Cited

U.S. PATENT DOCUMENTS 4,856,287 A * 8/1989 Oike ..... 62/126
5,276,630 A * 1/1994 Baldwin et al. ..... 700/276
5,983,653 A * 11/1999 Lee ..... 62/186

OTHER PUBLICATIONS

Korean Patent Abstract for Korean Publication No. 10-238061, Published Oct. 12, 1999.

* cited by examiner

*Primary Examiner*—Marc Norman
(74) *Attorney, Agent, or Firm*—Staas & Halsey LLP

(57) ABSTRACT

A refrigerator including a control unit for a condenser fan in connection with operation of a compressor if an outdoor temperature sensor is out of order. Since the condenser fan is driven in connection with the operation of the compressor, a trip phenomenon of the compressor generated due an overload of the compressor can be prevented, which results in stable operation of the refrigerator as well as increased reliability of the refrigerator.

7 Claims, 3 Drawing Sheets

REFRIGERATOR AND METHOD FOR CONTROLLING THE SAME

CROSS-REFERENCE TO RELATED APPLICATION

This application claims the benefit of Korean Patent Application No. 2004-21496, filed on Mar. 30, 2004 in the Korean Intellectual Property Office, the disclosure of which is incorporated herein by reference.

BACKGROUND OF THE INVENTION

1. Field of the Invention

The present invention relates to a refrigerator and a method for controlling the same, and, more particularly, to a refrigerator and a method for controlling the same, which is capable of controlling a condenser fan in connection with operation of a compressor when an outdoor temperature sensor is out of order.

2. Description of the Related Art

A refrigerator generates cold air required for refrigeration or freezing, by using a cooling system including a compressor, a condenser, an expansion unit, an evaporator, a condenser fan, various kinds of sensors for collecting information required to perform a cooling operation, etc.

In the cooling system, the evaporator is disposed inside a body typically partitioned into a refrigerating chamber and a freezing chamber, and the compressor, the condenser, the condenser fan and the like are installed in a machine room under the body. The refrigerator employing such a cooling system performs self-diagnosis for components of the refrigerator before a normal cooling operation is performed. In the self-diagnosis, if an outdoor sensor is found to short or open, disorder of the outdoor sensor is alerted by a buzzer or a light emitting lamp. Simultaneously, operation of the condenser fan driven depending on the outdoor sensor is stopped since temperature obtained through the outdoor sensor is different from actual outdoor temperature. Then, when the compressor is driven according to operation load of the cooling system, it suffers from an overload as cooling function of the condenser is remarkably deteriorated due to the stoppage of the condenser fan. Particularly, when the temperature of the compressor rises excessively as the outdoor temperature becomes very high in the summer, an overload protector provided to protect the compressor operates to cut off a power supply, which results in a trip phenomenon wherein the operation of the compressor is compulsorily stopped. Since it takes a long time for this trip phenomenon of the compressor to disappear, reliability of the refrigerator is lowered and normal operation of the refrigerator for refrigerating or freezing food or beverages is hindered.

SUMMARY OF THE INVENTION

Therefore, it is an aspect of the invention to provide a refrigerator and a method for controlling the same, which is capable of preventing a trip phenomenon of a compressor by driving a condenser fan in connection with operation of the compressor if an outdoor temperature sensor is out of order.

In accordance with one aspect of the present invention, there is provided a refrigerator comprising: a compressor; a condenser; a condenser fan; an outdoor temperature sensor; and a control unit for determining whether the compressor is operated or not based on operation load of the refrigerator if the outdoor temperature sensor is out of order and controlling the condenser fan in connection with operation of the compressor.

The refrigerator may further comprise at least one built-in temperature sensor for detecting temperature of a freezing chamber and/or a refrigerating chamber and the control unit calculates the operation load of the refrigerator based on the temperature of the freezing chamber and/or the refrigerating chamber detected by the at least one built-in temperature sensor.

The outdoor temperature sensor may include a negative temperature characteristic thermistor and resistors.

In accordance with another aspect of the present invention, there is provided a method for controlling a refrigerator, comprising: supplying a power; diagnosing disorder of an outdoor temperature sensor; determining whether a compressor is operated or not based on operation load of the refrigerator if the outdoor temperature sensor is out of order; and controlling a condenser fan in connection with operation of the compressor.

A voltage of the outdoor temperature sensor may be compared to a reference voltage, and the disorder of the outdoor temperature sensor is diagnosed based on a result of the comparison.

BRIEF DESCRIPTION OF THE DRAWINGS

The above aspects, and other features and advantages of the present invention will become more apparent after reading the following detailed description when taken in conjunction with the drawings, in which.

DETAILED DESCRIPTION OF THE PREFERRED EMBODIMENTS

Preferred embodiments of the present invention will now be described in detail with reference to the annexed drawings.

In a refrigerator in accordance with the present invention, a freezing chamber (not shown) and a refrigerating chamber (not shown) are provided with respective evaporators. A refrigerant cycle is configured by connecting each evaporator to a compressor, a condenser, an expansion valve, etc. by means of a refrigerant pipe. In addition, each evaporator is provided with a defrosting heater and a temperature sensor.

Figure 1:
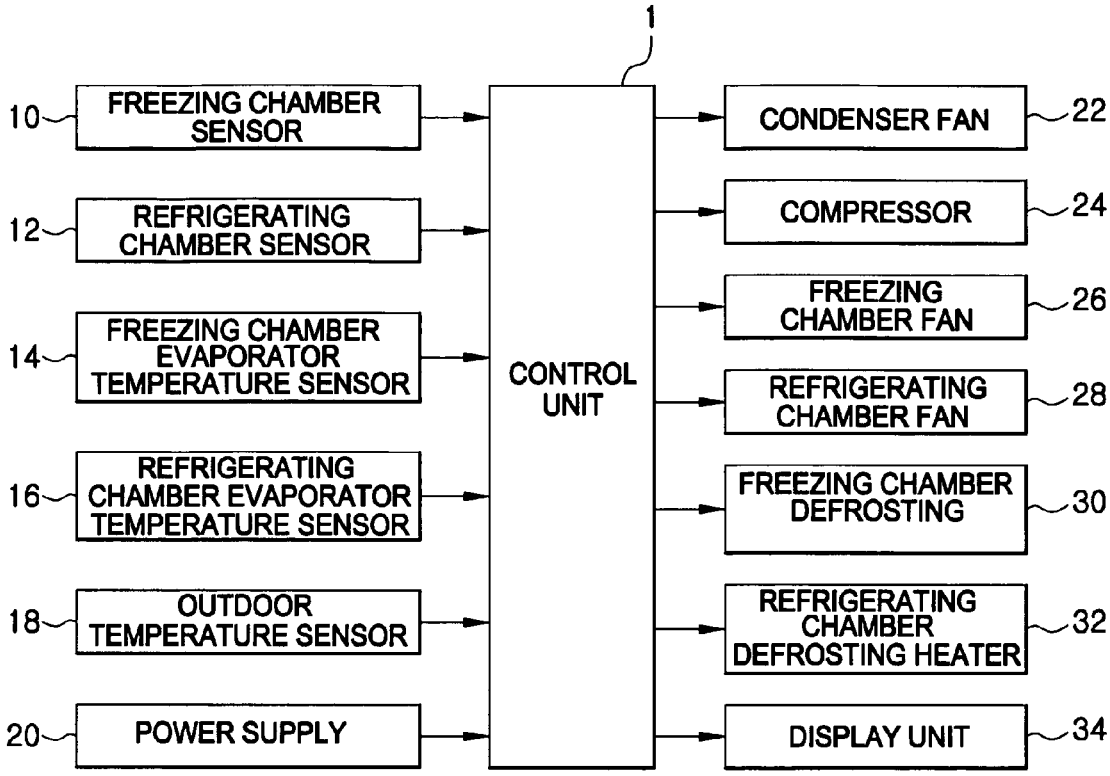
FIG. 1 is a block diagram showing a configuration of a refrigerator according to the present invention.
Figure 2:
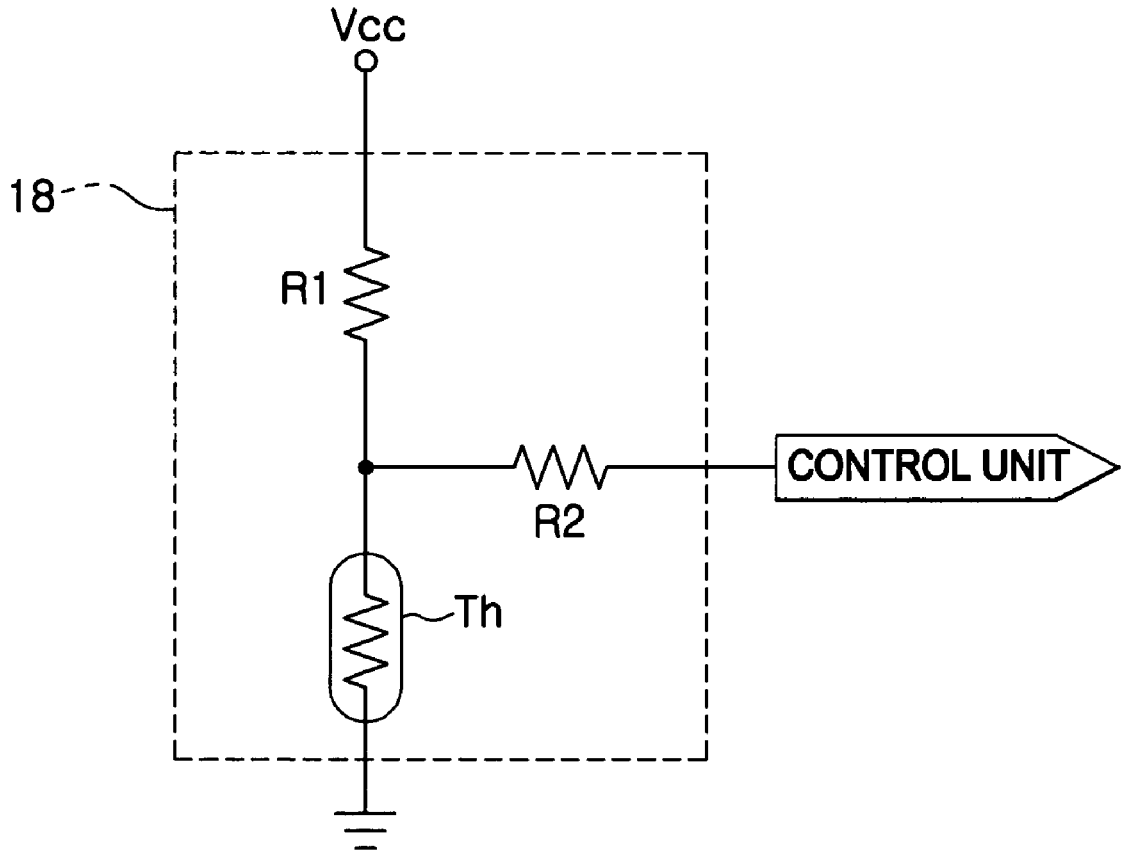
FIG. 2 is an electrical circuit of an outdoor temperature sensor of FIG. 1.

As shown in FIG. 1, the refrigerator of the present invention includes various kinds of sensors required to perform cooling operation, that is, a freezing chamber sensor 10 for detecting the temperature of the freezing chamber, a refrigerating chamber sensor 12 for detecting the temperature of the freezing chamber, a freezing chamber evaporator temperature sensor 14 installed in the evaporator of the freezing chamber for detecting the temperature of the evaporator, a refrigerating chamber evaporator temperature sensor 16 installed in the evaporator of the refrigerating chamber for detecting the temperature of the evaporator, and an outdoor temperature sensor 18 for detecting outdoor temperature. These sensors provide information on the detected temperature to a control unit 1.

A power supply 20 supplies power for each of components including the control unit 1 and the sensors.

Upon receiving the power, the control unit 1 makes a self-diagnosis for disorder of the sensors to find the sensors open or short by comparing a voltage of each sensor to a preset voltage.

After completing the self-diagnosis, the control unit 1 determines operation load of the refrigerator based on temperature information received from the sensors, drives a condenser fan 22, a compressor 24, a freezing chamber fan 26, and a refrigerating chamber fan 28 to perform cooling operation of the refrigerator, and drives a freezing chamber defrosting heater 30 and a refrigerating chamber defrosting heater 32 for performing defrosting operation of the refrigerator.

A display unit 34 displays the operation state of the refrigerator and so on.

The outdoor temperature sensor 18 includes resistors R1 and R2 for dividing an operating voltage Vcc, and a negative temperature characteristic (NTC) thermistor Th connected between a joining point between the resistors R1 and R2 and a ground. An outdoor detection signal corresponding to temperature detected by the thermistor Th is applied to the control unit 1 via the resistor R2. The control unit 1 converts the outdoor detection signal into a digital signal to recognize the outdoor temperature based on the converted temperature signal, i.e., a voltage value of the outdoor temperature sensor.

The resistance of the thermistor Th depends on the outdoor temperature and, accordingly, the voltage of the outdoor temperature sensor is applied to the control unit 1. The control unit 1 makes a self-diagnosis for disorder of the outdoor temperature sensor by comparing the voltage value of the sensor to a preset voltage value. For example, the control unit 1 determines that the sensor is out of order due to short of the sensor, if the sensor voltage is less than the preset voltage value (e.g., 0.6 V), which results in detection of temperature higher than the actual outdoor temperature, and determines that the sensor is out of order due to open of the sensor, if the sensor voltage is more than the preset voltage value (e.g., 4.5 V), which results in detection of temperature lower than the actual outdoor temperature.

When the disorder of the outdoor temperature sensor is diagnosed, the control unit 1 display the sensor disorder through the display unit 34 such that a user can read the sensor disorder.

Although the sensor disorder takes place, since it does not indicate a critical defect by which it is difficult to make perform cooling operation of the refrigerating chamber and the freezing chamber, it is necessary to continue to drive the compressor in order to continue the cooling operation to refrigerate or freeze food or beverages until the disordered sensor is repaired or changed. In other words, if temperatures of the freezing chamber and the refrigerating chamber are higher than respective preset temperatures, the compressor is driven to supply cold air into the chambers in order to lower the temperatures of the chambers and is stopped when the temperatures of the chambers fall under the respective preset temperatures due to the cooling operation.

Figure 3:
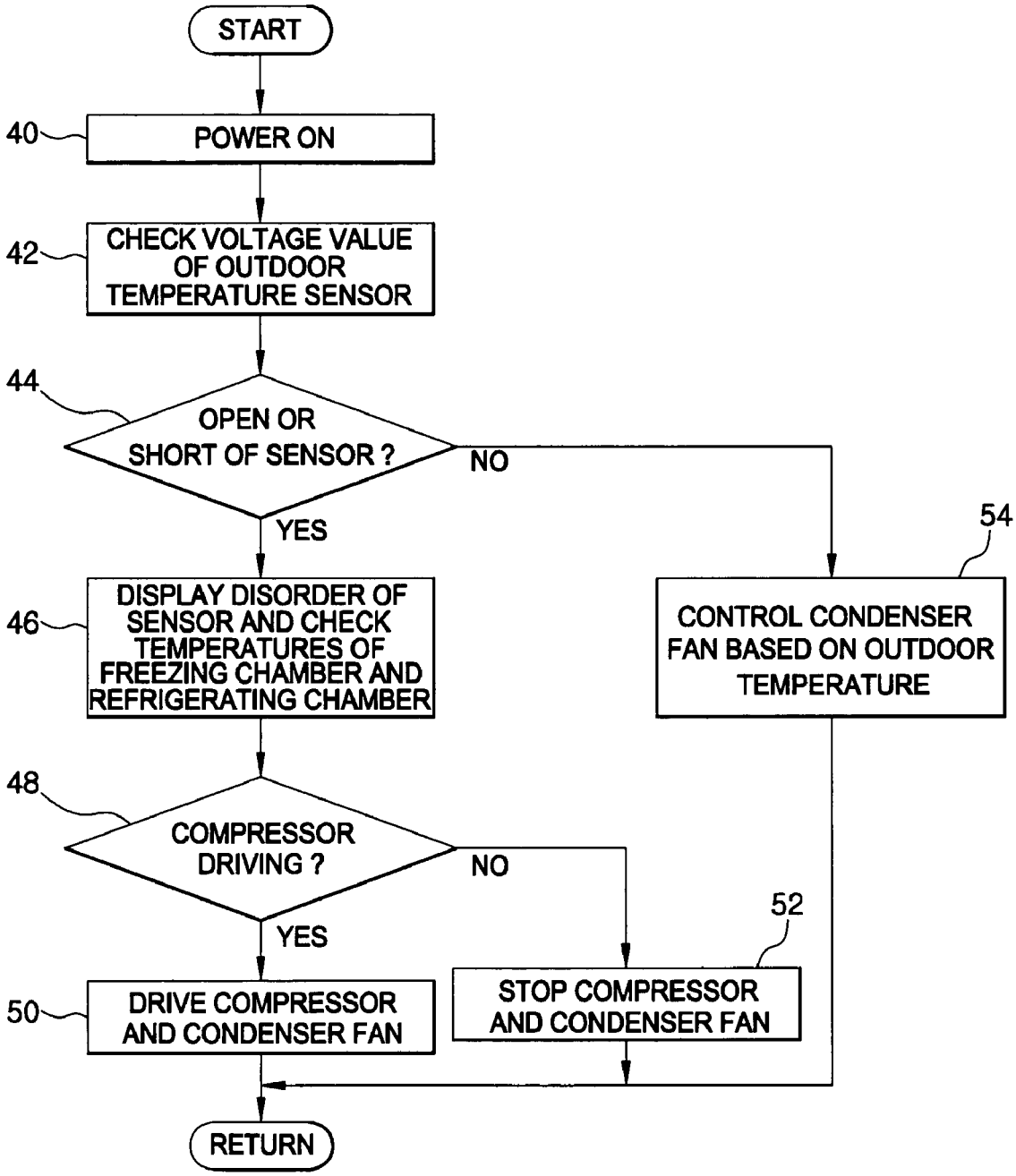
FIG. 3 is a flow chart illustrating a method for controlling a refrigerator in accordance with the present invention.

The control unit 1 drives the condenser fan 22 in connection with the operation of the compressor when the outdoor temperature sensor is out of order, which will be described below with reference to FIG. 3.

First, the refrigerator is powered on in operation 40. The control unit 1 is supplied with an operating voltage through the power supply 20 and checks a voltage value of the outdoor temperature sensor in operation 42.

The control unit 1 compares the voltage value of the outdoor temperature sensor to a preset voltage value (for example, 0.6 V or 4.5 V) to determine whether the sensor is open or short in operation 44.

As a result of the determination, if the sensor voltage is less than a preset lowest limit voltage (for example, 0.6 V) or more than a preset upper limit voltage (for example, 4.5 V), that is, if the sensor is open or short, the control unit 1 displays the disorder of the sensor on the display unit 34, compares temperatures detected by the freezing chamber temperature sensor 10 and the refrigerating chamber temperature sensor 12 to respective preset temperatures, and calculates the operation load of the refrigerator based a result of the comparison in operation 46. Next, the control unit 1 determines whether the compressor is driven or not based on the calculated operation load in operation 48. As a result of the determination in operation 48, if it is determined that the compressor is required to be driven as the temperatures of the chambers are higher than the respective preset temperatures and the operation load is large, the control unit 1 drives the condenser fan 22 at the same time as driving the compressor 24. Accordingly, although the outdoor temperature cannot be detected by the outdoor temperature sensor, the trip phenomenon of the compressor can be prevented since the condenser fan is driven as the compressor is driven in operation 50.

As a result of the determination in operation 48, if it is determined that the compressor is not required to be driven as the operation load is not large, the control unit 1 stops the compressor 24 and the condenser fan 22 in operation 52.

On the other hand, as a result of the determination in operation 44, if it is determined that the outdoor temperature sensor is not open or short, the control unit 1 controls the compressor and the condenser fan based on the outdoor temperature detected by the outdoor temperature sensor.

As apparent from the above description, since the condenser fan is driven in connection with the operation of the compressor if the outdoor temperature sensor is out of order, the trip phenomenon of the compressor generated due an overload of the compressor can be prevented, which results in stable operation of the refrigerator as well as increase of reliability of the refrigerator.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising: a compressor; a condenser; a condenser fan; an outdoor temperature sensor; and a control unit for determining whether the compressor is operated or not based on operation load of the refrigerator if the outdoor temperature sensor is out of order and controlling the condenser fan in connection with operation of the compressor.

2. The refrigerator as set forth in claim 1, further comprising at least one built-in temperature sensor for detecting temperature of a freezing chamber and/or a refrigerating chamber, wherein the control unit calculates the operation load of the refrigerator based on the temperature of the freezing chamber and/or the refrigerating chamber detected by the at least one built-in temperature sensor.

3. The refrigerator as set forth in claim 1, wherein the outdoor temperature sensor includes a negative temperature characteristic thermistor and resistors.

4. A method for controlling a refrigerator, comprising:

supplying a power;

diagnosing disorder of an outdoor temperature sensor;

determining whether a compressor is operated or not based on operation load of the refrigerator if the outdoor temperature sensor is out of order; and controlling a condenser fan in connection with operation of the compressor.

5. The method as set forth in claim 4, wherein a voltage of the outdoor temperature sensor is compared to a reference voltage, the disorder of the outdoor temperature sensor is diagnosed based on a result of the comparison, and if a sensor disorder is detected, the control unit displaying the sensor disorder through a display unit.

6. A condenser fan controller for use in a refrigerator including a compressor, a condenser, a condenser fan, and an outdoor temperature sensor, said condenser fan controller comprising:

a control unit running the compressor responsive to an operation load of the refrigerator if the outdoor temperature sensor is out of order and for controlling the condenser fan responsive to the running of the compressor.

7. A method of controlling a refrigerator, comprising:

determining whether an outdoor temperature sensor is operating;

turning a compressor on and off responsive to an operation load of the refrigerator when the outdoor temperature sensor is not operating; and turning on a condenser fan when the compressor is on and turning off the condenser fan when the compressor is off.

* * * * *

UNITED STATES PATENT AND TRADEMARK OFFICE

CERTIFICATE OF CORRECTION

PATENT NO. : 7,024,873 B2
APPLICATION NO. : 10/814790
DATED : April 11, 2006
INVENTOR(S) : Han Joo Yoo It is certified that error appears in the above-identified patent and that said Letters Patent is hereby corrected as shown below:

On Title Page, Col. 2 item (57), Abstract, line 5, after "due" insert --to--

Signed and Sealed this

Fifth Day of September, 2006

JON W. DUDAS
*Director of the United States Patent and Trademark Office*